US006587661B1

(12) United States Patent
Shimmura et al.

(10) Patent No.: US 6,587,661 B1
(45) Date of Patent: Jul. 1, 2003

(54) IMAGE FORMING APPARATUS

(75) Inventors: Shoko Shimmura, Tokyo (JP); Takeshi Watanabe, Ichikawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,349

(22) Filed: Jan. 30, 2002

(51) Int. Cl.[7] ..... G03G 15/08
(52) U.S. Cl. ..... 399/257; 399/35; 399/259
(58) Field of Search ..... 399/27, 29, 30, 399/35, 99, 120, 222, 258, 259, 260, 264, 358, 360, 257; 222/DIG. 1

(56) References Cited

U.S. PATENT DOCUMENTS

| | | | | |
|---|---|---|---|---|
| 4,614,165 A | | 9/1986 | Folkins et al. | |
| 4,891,673 A | * | 1/1990 | Buell | 399/257 |
| 5,095,338 A | * | 3/1992 | Hays, Jr. et al. | 399/257 |
| 5,237,373 A | * | 8/1993 | Aimoto et al. | 399/35 |
| 5,260,747 A | * | 11/1993 | Uwagawa et al. | 399/257 |
| 5,260,755 A | * | 11/1993 | Imaizumi | 399/35 |
| 5,307,123 A | * | 4/1994 | Aimoto | 399/257 |
| 5,548,385 A | | 8/1996 | Takai et al. | |
| 5,592,270 A | | 1/1997 | Takai et al. | |
| 6,353,722 B1 | * | 3/2002 | Klimley et al. | 399/257 |

FOREIGN PATENT DOCUMENTS

| | | | |
|---|---|---|---|
| JP | 64-91162 | * | 4/1989 |
| JP | 2-21591 | | 5/1990 |
| JP | 7-111598 | | 11/1995 |
| JP | 10-48937 | | 2/1998 |
| JP | 10-90991 | | 4/1998 |
| JP | 2866319 | | 12/1998 |
| JP | 2891845 | | 2/1999 |
| JP | 11-119531 | | 4/1999 |
| JP | 2930834 | | 5/1999 |
| JP | 2986001 | | 10/1999 |

* cited by examiner

*Primary Examiner*—Sandra Brase
(74) *Attorney, Agent, or Firm*—Foley & Lardner

(57) ABSTRACT

A developing apparatus is provided in which the concentration of a toner in a developer material and the amount of developer material is kept constant by the use of simple mechanical parts so as not to deteriorate the electrification performance of the developer material. In the image forming apparatus of the present invention, a pocket 25 of a discharged developer material weighing part 20 receives a discharged developer material discharged from a developer material discharge port 14. Each time the accumulated weight thereof reaches a prescribed weight, the discharged developer material thus received is discharged into a discharged developer material receiving part 30, and this discharge is detected by a sensor 27. An unillustrated control unit counts this detection and calculates an amount of carrier decreased. Based on this result, a carrier supply roller 13 of the replenishment device is driven to replenish the carrier. On the other hand, the consumption of the toner is detected by a toner concentration sensor, and the control unit replenishes the toner by means of a replenishment device 10. The mixing ratio by weight of the toner and the carrier in the developer material and the amount of the developer material held in each of developer material supply, path sections 5, 6 are kept constant under the control operation of this control unit. As a result, the formation of excellent images can be continued for an extended period of time.

10 Claims, 4 Drawing Sheets

IMAGE FORMING APPARATUS

BACKGROUND OF THE INVENTION

1. Field of the Invention

The present invention relates to an image forming apparatus for a dry electrophotographic developing apparatus and the like, and in particular it elates to an image forming apparatus equipped with such a developing apparatus in which a toner and a carrier corresponding in amounts to their consumptions are replenished to a developer material supply path from a toner replenishment device and a carrier replenishment device thereby to maintain the mixing ratio by weight between the toner and the carrier constituting the developer material and the amount of the developer material held in the developer material supply path at constant levels, respectively, wherein a part of the developer material held in the developer material supply path is supplied to a photoreceptor through a developing roller while being stirred, so that a latent image formed on the photoreceptor is visualized by the toner contained in the developer material thus supplied, and at the same time, that part of the developer material to be held in the developer material supply path which exceeds a predetermined amount is discharged as a discharged developer material from a developer material discharge port and received in a discharged developer material receiving part.

2. Description of the Related Art

In a developing apparatus of an image forming apparatus applying an electrophotographic method, a method (trickle development) using a developer material composed of at least two components, a carrier and a toner, is mainstream. In the case of a developing apparatus using such a type of developer material, it is necessary to stir a carrier and a toner thereby to electrify the toner through stirring friction. However, a resin constituting the toner is fused to the carrier due to the heat of stirring friction, so that the carrier is gradually coated with the fused toner, finally reaching a state in which the carrier is contaminated by coatings. Thus, when the carrier comes to the state of contamination, it becomes impossible to sufficiently electrify the toner by the stirring friction, resulting in the formation of defective images. In order to avoid such defective images, conventionally, the entire amount of developer material has been replaced with a new one when the period of use of the developer material exceeds a prescribed period of time.

When the developer material is taken out of a container for such a replacement, there might arise a problem that the developer material is dispersed or scattered around to float in the surroundings and contaminate the surrounding environment. Accordingly, it is necessary to carry out the replacement of the developer material carefully, and hence replacing the entire developer material requires a lot of time. Thus, it has been proposed to replace the container storing the developer material on the whole in order to avoid such an annoying or troublesome replacement operation. However, by merely facilitating the replacement of the container without taking appropriate measures as to how to use the developer material, the amount of developer material to be wasted is not decreased at all. The developer material cannot be wasted or discarded as general garbage. Therefore, it is necessary to perform special processing on the developer material to be discarded. Thus, as the amount of wasted developer material increases, the cost of maintaining the developing apparatus increases, too.

As an invention with a possibility of solving the above-mentioned problem, there is a developing apparatus for an electrophotographic copier using a trickle development method as disclosed in Japanese Patent Publication No. 2-21591 (corresponding to U.S. Pat. No. 4,614,165). In this developing apparatus, a new carrier is replenished to the developing apparatus little by little in accordance with the replenishment of a toner, and a part of the surplus developer material is similarly discharged from the developing apparatus to a developer material collection tank little by little, whereby the developer material in the developing apparatus is continuously refreshed little by little. As a result, the deterioration speed of the electrification performance of the developer material used can be greatly slowed down, so that the usable life of the developer material can be extended to the same extent as the service life of the developing apparatus. In this developing apparatus, however, only the height of a weir installed in a discharge port is finally controlled so as to adjust the discharge of the deteriorated developer material, but the amount of the discharge is not fed back to the amount of supply of the developer material. Thus, it is impossible to perform the replenishment or discharge of the developer material at an amount corresponding to the amount of the discharge or replenishment thereof in an accurate manner. As a result, the amount of developer material in a development tank varies, making it impossible to carry out the precise control of keeping the concentration of the toner and the electrification performance of the developer material in the development tank in a good condition.

Thus, there have been made proposals for improved developing apparatuses such as, for example, those disclosed in Japanese Patent No. 2,986,001 (corresponding to U.S. Pat. No. 5,548,385) and in Japanese Patent No. 2,930,834 (corresponding to U.S. Pat. No. 5,592,270). In the developing apparatus disclosed in the Japanese Patent No. 2,986,001, a toner concentration sensor is arranged in a development tank, and a magnetic permeability sensor is arranged in a developer material collection tank. A control unit calculates the amount of developer material in the development tank from outputs of the toner concentration sensor and the magnetic permeability sensor, and performs control in such a manner that the amount of developer material in the development tank is made constant, thereby keeping the electrification performance thereof in a good condition. On the other hand, in the developing apparatus disclosed in Japanese Patent No. 2,930,834, a shutter, which can be opened and closed under the action of a solenoid, is arranged in a discharge port, and it is controlled to discharge a developer material at an amount corresponding to the amount of replenishment thereof. However, with the arrangements in the above examples as disclosed in Japanese Patent No. 2,986,001 and in Japanese Patent No. 2,930,834, the component parts employed are expensive and the control required thereof becomes complicated since the magnetic permeability sensor or the like is arranged in the developer material collection tank, or the shutter is arranged in the developer material discharge port, so that the sensor or shutter is controlled by a control circuit to keep the amount of developer material in the development tank at a constant level so as not to deteriorate the electrification performance of the developer material in the development tank. In addition, in cases where developing is performed in full color, it is necessary to install four sets of these elements in the developing apparatus, thus resulting in a substantial increase in the cost.

SUMMARY OF THE INVENTION

The present invention has been made to solve the above-mentioned problems, and has for its object to provide an image forming apparatus which is capable of keeping the weight ratio between a toner and a carrier in a developer material inside a development tank as well as the amount of the developer material at their prescribed constant values even with the use of simple component parts and easy control.

In order to solve the above-mentioned problems, the present invention resides in an image forming apparatus equipped with a developing apparatus in which a toner and a carrier constituting a developer material are replenished from a replenishment device to a developer material supply path, and in which an excess part of the amount of developer material to be held in the developer material supply path is discharged from a developer material discharge port as a discharged developer material and received in a discharged developer material receiving part. The developing apparatus, for the purpose of replenishing the carrier, includes: a discharged developer material weighing mechanism which receives the discharged developer material discharged from the developer material discharge port, and discharges the discharged developer material thus received into the discharged developer material receiving part each time the accumulated weight of the received discharged developer material reaches a prescribed weight; a sensor which detects that the discharged developer material weighing mechanism has discharged the discharged developer material into the discharged developer material receiving part; and a control unit which calculates an amount of discharge carrier corresponding to the detection of the sensor, and replenishes the carrier corresponding to the amount of discharged carrier thus calculated from the replenishment device into the developer material supply path.

With such a construction, the discharged developer material weighing mechanism receives the discharged developer material discharged from the developer material discharge port, and each time the accumulated weight of the received discharged developer material reaches a prescribed weight, the received discharged developer material is discharged into the discharged developer material receiving part. This discharge is detected by the sensor, and the control unit counts this detection and calculates an amount of carrier decreased, as a result of which the control unit drives the replenishment device to replenish the carrier. On the other hand, the consumption of the toner is detected by a toner concentration sensor, and the control unit replenishes the toner from the replenishment device. The mixing ratio by weight of the toner and the carrier, which together constitute the developer material, and the amount of developer material held in the developer material supply path is kept constant under such a control operation of the control unit.

In addition, in the present invention, the discharged developer material weighing mechanism includes: a rotation arm which is able to perform a seesaw movement about a rotation shaft within a prescribed angle range; a weight member which is mounted on one end of the rotation shaft; and a pocket which is mounted on the other end of the rotation arm and has a container shape for receiving the discharged developer material discharged from the developer material discharge port. The pocket is operable to rotate the rotation arm against the weight of the weight member and at the same time to discharge the discharged developer material received up to that time into the discharged developer material receiving part when the weight of the received discharged developer material exceeds a threshold. The pocket together with the rotation arm is returned to its original position under the action of the weight member after the discharge. Thus, the discharged developer material weighing mechanism is constituted by mechanical parts of simple structure, and hence achievement and handling thereof are easy.

Moreover, in the present invention, the discharged developer material weighing mechanism includes a lock mechanism which acts to lock the rotation arm against rotation thereof when a main electric power supply is turned off, and release the locking of the rotation arm when the main electric power supply is turned on. Thus, even if the image forming apparatus is inclined due to its movement or the like when the main electric power supply is turned off, the discharge of a large amount of developer material is prevented.

Further, in the present invention, the weight member is constructed such that a distance thereof from the rotation shaft is adjustable. Accordingly, it is possible to adjust the weight of the discharged developer material as necessary which can be measured at one time by the discharged developer material weighing mechanism.

Furthermore, in the present invention, the control unit calculates the accumulated amount of developer material discharged into the discharged developer material receiving part based on the number of detections of the sensor, and when a prescribed amount of accumulation is reached, the control unit displays an indication of that effect at a display device, or generates a warning sound. Thus, an operator is able to automatically learn the timing at which the discharged developer material receiving part should be replaced with an empty one without the arrangement of a complicated detection mechanism.

Still further, in the present invention, the developer material supply path comprises: a first developer material supply path section disposed adjacent to a developing roller for mixing and transporting the developer material along the developing roller; and a second developer material supply path disposed on the opposite side of the developing roller along the first developer material supply path section. The developer material supply path is constructed such that the developer material is fed from a transportation terminating end of the second developer material supply path section at a transportation starting end of the first developer material supply path section. The developer material is fed from a transportation terminating end of the first developer material supply path section to a transportation starting end of the second developer material supply path section at the transportation terminating end of the first developer material supply path section, and at the same time, a part of the developer material is discharged from the developer material discharge port as a discharged developer material. A bottom of the first developer material supply path section at the transportation terminating end thereof becomes gradually shallow toward a direction of transportation. With this arrangement, the chances of the developer material staying at corners or the like of the transportation terminating end of the first developer material supply path section without being recirculated are extremely reduced.

Additionally, in the present invention, a bottom of the second developer material supply path section is constructed such that it becomes gradually shallow toward the direction of transportation at the transportation terminating end of the second developer material supply path section, too, as at the transportation terminating end of the first developer material supply path section. Thus, the chances of the developer material staying at corners or the like of the transportation terminating ends of the first and second developer material supply path sections without being recirculated are extremely reduced.

Further, in the present invention, the image forming apparatus is constructed such that a first auger and a second auger both extending in the direction of transportation of the developer material are disposed in the first and second developer material supply path sections, respectively, and that the outer diameter of the first auger at the transportation terminating end of the first developer material supply path section decreases toward the direction of transportation so as to correspond to the bottom of the first developer material supply path section which becomes gradually shallow toward the direction of transportation.

Furthermore, in the present invention, the image forming apparatus is constructed such that a first auger and a second auger both extending in the direction of transportation of the developer material are disposed in the first and second developer material supply path sections, respectively, and that the outer diameters of the first and second augers at the transportation terminating ends of the first and second developer material supply path sections decrease toward the direction of transportation so as to correspond to the bottoms of the first and second developer material supply path sections which become gradually shallow toward the direction of transportation.

DESCRIPTION OF THE PREFERRED EMBODIMENTS

Figure 1:
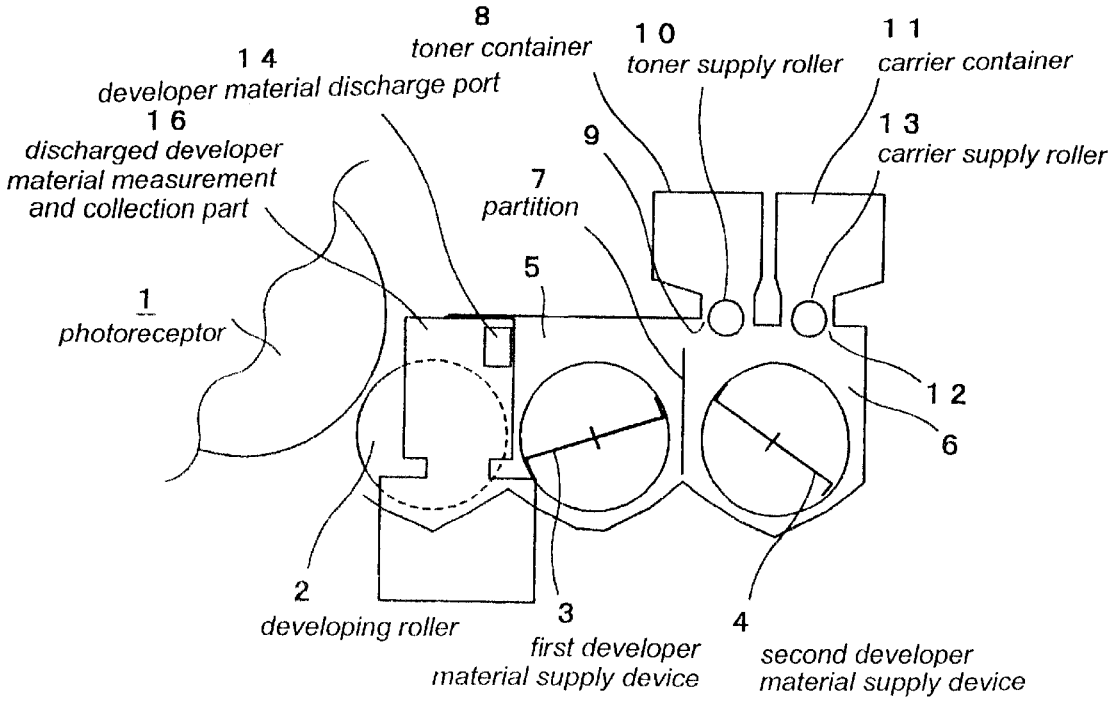
FIG. 1 is a cross sectional view showing an embodiment of an image forming apparatus according to the present invention.
Figure 2:
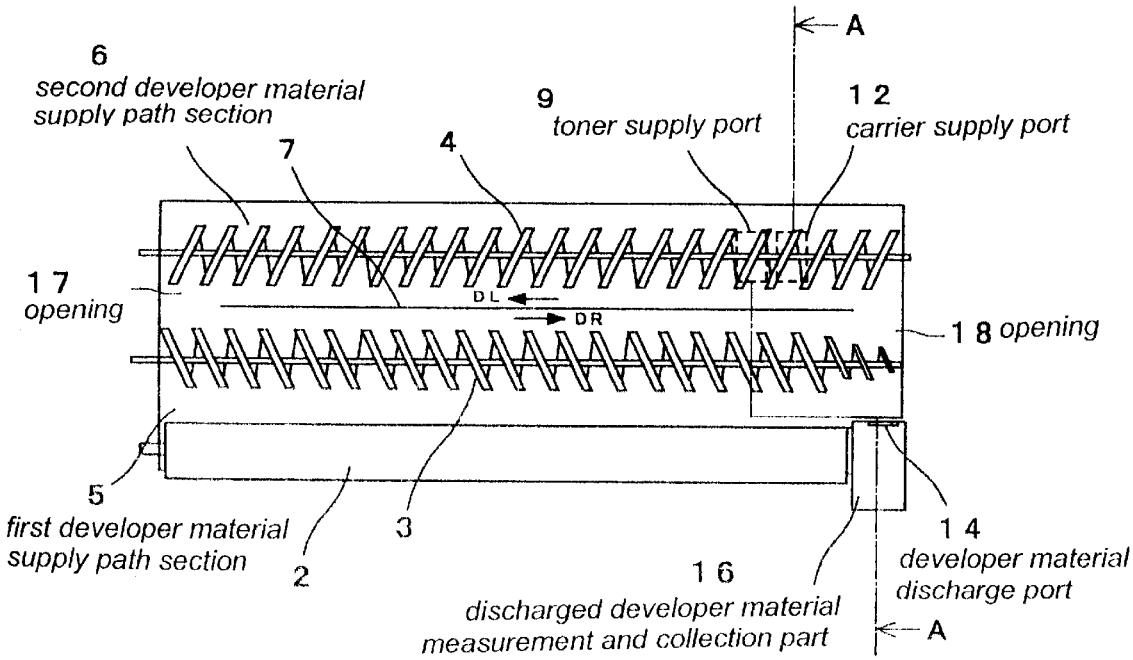
FIG. 2 is a plan view showing the entire portion of a developing apparatus used for the image forming apparatus of FIG. 1.
Figure 3:
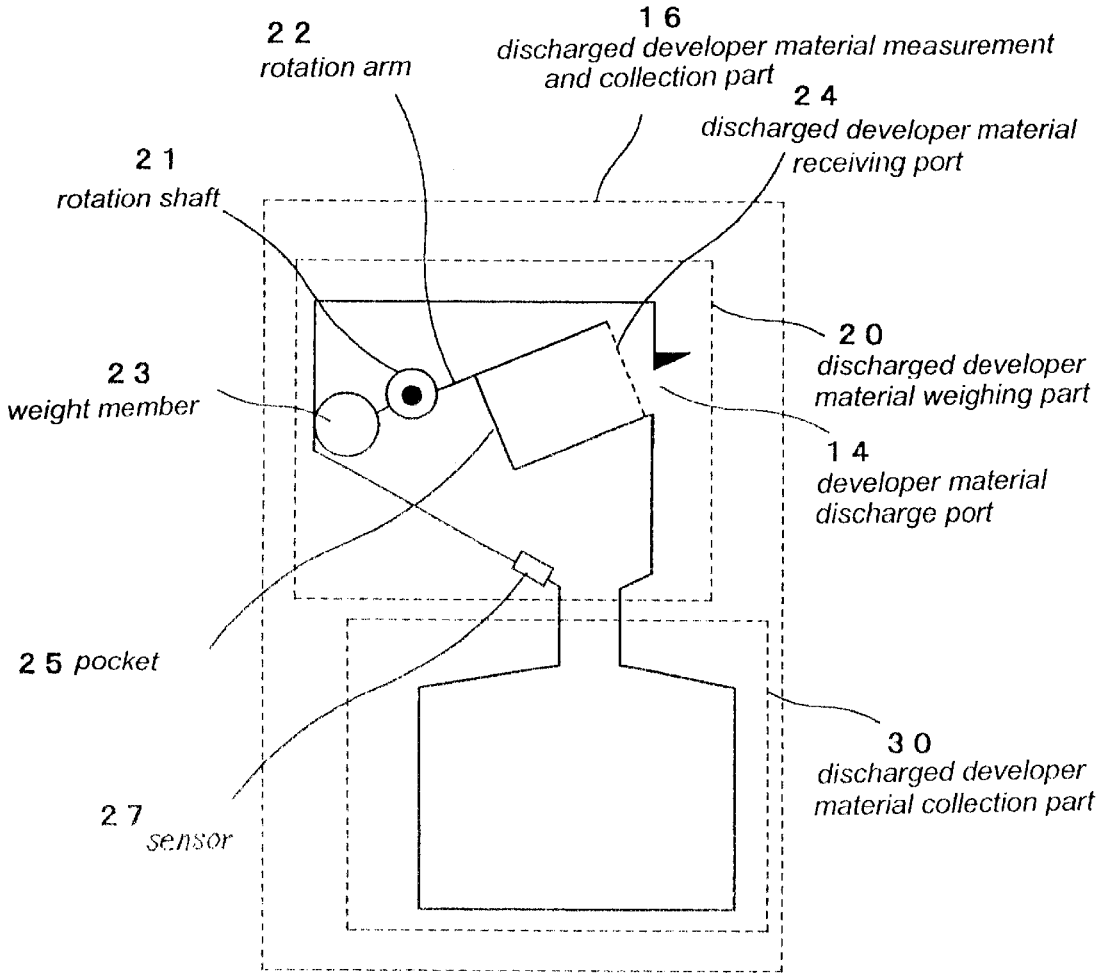
FIG. 3 is a cross sectional view showing in detail the construction of a discharged developer material measurement and collection part 16 shown in FIG. 1.
Figure 4:
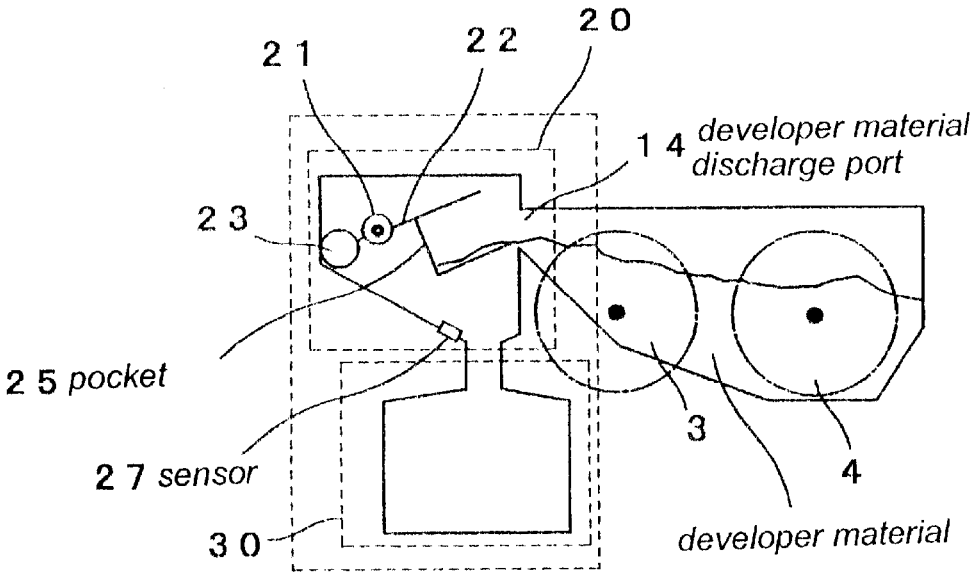
FIG. 4 is a cross sectional view showing the state in which the weight of a developer material discharged from a developer material discharge port and received in a pocket of FIG. 3 is small during operation of the image forming apparatus of FIG. 1.
Figure 5:
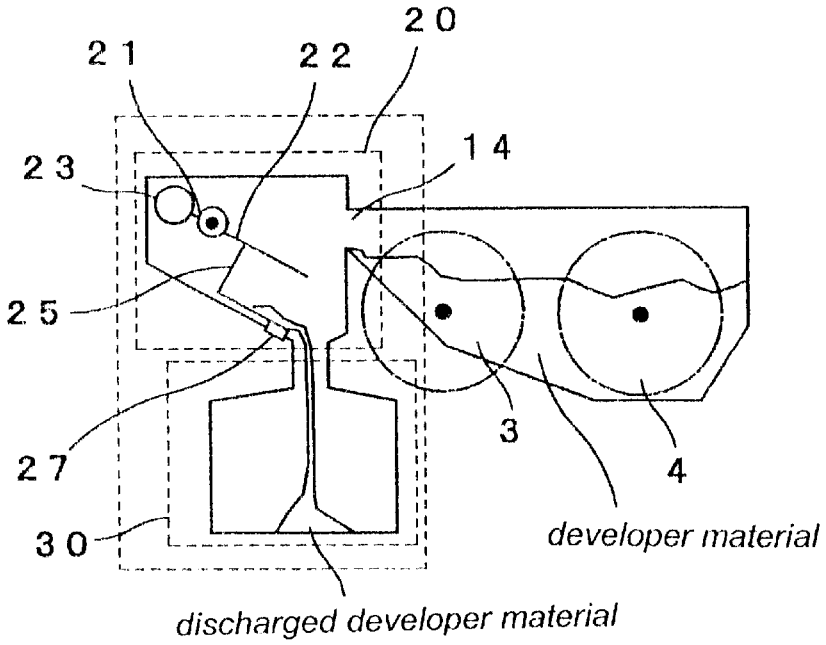
FIG. 5 is a cross sectional view showing the state in which the weight of the discharged developer material received in the pocket has increased from the state of FIG. 4 with a rotation arm having been rotated.

Hereinafter, preferred embodiments of the present invention will be described based on the accompanying drawings. FIG. 1 is a cross sectional view which shows an embodiment of an image forming apparatus according to the present invention. FIG. 2 is a plan view which shows the entire portion of a developing apparatus used for the image forming apparatus of FIG. 1. FIG. 3 is a cross sectional view which shows the detailed construction of a discharged developer material measurement and collection part 16 shown in FIG. 1. FIG. 4 is a cross sectional view which shows the state in which the weight of a developer material discharged from a developer material discharge port and received in a pocket of FIG. 3 is small during the operation of the image forming apparatus of FIG. 1. FIG. 5 is a cross sectional view which shows the state in which the weight of the discharged developer material received in the pocket has increased from the state of FIG. 4 with a rotation arm having been rotated. Here, note that FIG. 1 corresponds to a cross sectional view seen from line A—A of FIG. 2.

As shown in FIG. 1 and FIG. 2, the image forming apparatus includes a cylindrical photoreceptor 1, a developing roller (magnet roller) 2 which supplies a toner to the photoreceptor 1 thereby to visualize or develop a latent image formed on the photoreceptor 1, a first developer material supply device 3 (for instance, auger) which supplies a developer material containing a toner and a carrier mixed with each other at a predetermined weight ratio thereof to the developing roller 2, a second developer material supply device 4 which similarly supplies a developer material to the first developer material supply device 3, a partition 7 which is disposed between the first and second developer material supply devices 3, 4 to divide most of the central portion, in which the first and second developer material supply devices 3, 4 are arranged, into a first and a second developer material supply path section 5, 6, a toner container 8 storing the toner therein, a toner supply roller 10 which supplies the toner stored in the toner container 8 from a toner supply port 9 to the second developer material supply device 4 according to an instruction of a control unit (not shown), a carrier container 11 storing the carrier therein, a carrier supply roller 13 which supplies the carrier stored in the carrier container 11 to the second developer material supply device 4 through a carrier supply port 12 according to an instruction of the control unit, a developer material discharge port 14 which is disposed adjacent to one axial end of the developing roller 2, and the discharged developer material measurement and collection part 16 which measures the weight of the developer material discharged (overflowing) from the developer material discharge port 14 and collects it.

The above-mentioned discharged developer material measurement and collection part 16 is constituted by an upper discharged developer material weighing part 20 and a lower discharged developer material receiving part 30 both accommodated in a casing, as shown in FIG. 3. The discharged developer material receiving part 30 is detachably connected with the discharged developer material weighing part 20, and receives the discharged developer material that falls from the discharged developer material weighing part 20. The discharged developer material receiving part 30 is replaced with an empty discharged developer material receiving part 30 when the discharged developer material received therein becomes a prescribed amount. The discharged developer material weighing part 20 includes, as mechanical parts, a rotation shaft 21 which is installed in parallel to the central axis of the developing roller 2, a rotation arm 22 which is mounted on the rotation shaft 21 in such a manner that it is rotatable in a plane perpendicular to the rotation shaft 21, a weight member 23 which is mounted on one end of the rotation arm 22 which extends in a straight line, and a pocket 25 which is mounted on the other end of the rotation arm 22. In addition, arranged on the bottom of the pocket 25 is a sensor 27 which detects a weight measurement by the pocket 25 each time the weighing by the pocket 25 is carried out.

The pocket 25 takes the shape of a hexahedral box disposed in a direction in which the rotation arm 22 extends, and it has two side surfaces arranged in a direction perpendicular to the rotation shaft 21, with one of the two side surfaces, which is more remote from the rotation shaft 21 than the other, acting as a discharged developer material receiving port 24 in an open state. Therefore, when the inside of the pocket 25 is empty for example, the rotation arm 22 is caused to rotate about the rotation shaft 21 in the counterclockwise direction under the action of the weight member 23, and it is restricted to stop at a prescribed angle of rotation, as shown in FIG. 3. In this state of the rotation being stopped, the lower side of the discharged developer material receiving port 24 substantially coincides with the lower side of the developer material discharge port 14.

Next, reference will be made to the operation of the developing apparatus shown in FIG. 1 through FIG. 3 while referring to FIG. 4 and FIG. 5 in combination. First, the second developer material supply device 4 (in a typical example, constituted by an auger as shown in FIG. 2), which is arranged in the second developer material supply path section 6 of the development tank comprising the first and second developer material supply path sections 5, 6, is driven to rotate, whereby the developer material, in which the toner and the carrier are mixed with each other at a prescribed constant weight ratio thereof, is transported toward an opening 17 in the direction of arrow DL by way of the second developer material supply path section 6 while the toner and the carrier being further mixed with each other. The first developer material supply device 3 (constituted by an auger in FIG. 2) is driven to rotate, thereby transporting the developer material, which is fed thereto from the second developer material supply device 4 through the opening 17, in the direction of arrow DR through the first developer material supply path section 5 shown in FIG. 2 while further mixing the developer material.

During the transportation through the first developer material supply path section 5, the developer material is supplied to the photoreceptor 1 through the developing roller 2. The concentration of the developer material supplied from the first developer material supply path section 5 to the photoreceptor 1 is measured by a toner concentration sensor of the magnetic permeability sensor type (not shown). The concentration of the toner in the first developer material supply path section 5 decreases as image formation is performed. When the toner concentration sensor detects that the concentration of the toner becomes a prescribed value or below, the control unit drives the toner supply roller 10 to replenish the toner from the toner container 8 to the second developer material supply path section 6, so that the concentration of the developer material supplied to the photoreceptor 1 is controlled to a set concentration. In this case, although the toner and the carrier are replenished separately from each other, a developer material for replenishment use, which contains both the toner and the carrier with the concentration of the toner being higher than that of the ordinary developer material, may instead be furnished. Moreover, in another control method, the toner may be replenished by calculating a decrease in the concentration of the toner based on the measurement of the printing rate, the amount of development on the photoreceptor or the like. Alternatively, the concentration of the developer material supplied to the photoreceptor 1 may be controlled to its set concentration by replenishing a developer material for replenishment use with a high toner concentration.

In the case where the developer material is supplied to the photoreceptor 1 as referred to above, the circumferential direction of the surface of the developing roller 2 is constructed in such a manner that there are formed a supply pole, a transportation pole, a development pole, a transportation pole, and a discharge pole on the developing roller surface sequentially in the direction of rotation from a near-upper position facing the first developer material supply path section 5. With such a construction, the carrier is magnetically attracted to the supply pole facing the first developer material supply path section 5 whereby the toner is attracted to the carrier under the action of static electricity. Thereafter, the carrier and the toner are transported to the photoreceptor 1 side by the transportation pole, and then they are supplied to the photoreceptor 1 by the development pole facing the photoreceptor 1, after which the carrier and the toner remaining on the developing roller 2 are transported to the first developer material supply path section 5 side by the transportation pole. The carrier and the toner thus transported are discharged by the discharge pole formed at a near-lower position facing the first developer material supply path section 5 to be mixed with the developer material which is transported through the first developer material supply path section 5.

In this manner, the developer material transported through the first developer material supply path section 5 arrives at a place where it faces the developer material discharge port 14 and an opening 18, as shown in FIG. 2. The portion of the first developer material supply path section 5 which faces the developer material discharge port 14 and the opening 18 is formed in such a manner that the bottom thereof becomes gradually shallow toward the direction of transportation of the developer material, with the outside diameter of the first developer material supply device 3 gradually decreasing in the same direction, too. Most of the developer material, which has been transported to the place where it faces the developer material discharge port 14 and the opening 18, is returned to the second developer material supply path section 6 through the opening 18 so that it is mixed with another developer material in the second developer material supply path section 6 by the second developer material supply device 4 so as to be used again. On the other hand, a small part of the developer material, which has been transported to the place where it faces the developer material discharge port 14 by the first developer material supply device 3 through the first developer material supply path section 5, overflows from the developer material discharge port 14. In this case, the chances of the developer material staying at corners of a terminal end of the first developer material supply path section 5 without being recirculated as in the conventional ones are extremely remote because the bottom of the first developer material supply path section 5 becomes gradually shallow so as to go up in the vicinity of the developer material discharge port 14.

The developer material discharged from the developer material discharge port 14 little by little enters the pocket 25 of the discharged developer material weighing part 20 through the discharged developer material receiving port 24 to accumulate in the pocket 25 (FIG. 4). For example, let us assume that when the amount of the discharged developer material accumulated has reached a certain weight of Ga grams (1–50 g in a typical example), the sum of the own weight of the pocket of Sa grams and the weight of the accumulated developer material of Ga grams exceeds a predetermined threshold to upset the balance of weight thereof with respect to the weight member. At this time, the rotation arm 22 is caused to rotate about the rotation shaft 21 in the clockwise direction to move the pocket 25 in the downward direction. At the instant when the rotation arm 22 has been rotated by a predetermined angle of rotation, as shown in FIG. 5, it is stopped and at the same time the sensor 27 detects the fact that the rotation arm 22 has rotated through the predetermined angle. In addition, during the clockwise rotation of the rotation arm, the discharged developer material, which has been accumulated in the pocket 25 up to that time, falls from the pocket 25 into the discharged developer material receiving part 30. In this case, it is preferable that the inner wall of the pocket 25 be coated or finished so that the friction thereof with the discharged developer material may be reduced in order to enable all the discharged developer material accumulated in the pocket 25 to be swiftly discharged therefrom.

As the discharged developer material is discharged from the pocket 25, the weight of the pocket 25 decreases so that the rotation arm 22 is caused to rotate about the rotation shaft 21 in the counterclockwise direction under the action of the weight member 23 to return to the state shown in FIG. 4. By a single detection of the sensor 27, the control unit detects the fact that an amount of discharged developer material of Ga grams has been received in the discharged developer material receiving part 30. Incidentally, note that it is preferable that the weight member 23 be constructed such that the distance thereof from the rotation shaft 21 can be varied so as to change or finely adjust the weight of the discharged developer material of Ga grams measured at one time as necessary. In this case, it is preferable, by way of example, that the weight member 23 be threadedly engaged with the rotation arm 22 for the purpose of facilitating fine adjustments.

Since the discharged developer material measurement and collection part 16 is constructed as described above, the control unit of the image forming apparatus can easily calculate the weight of the discharged carrier (Ga X N) based on the number of measurements N detected by the sensor 27. Thus, the control unit drives the carrier supply roller 13 so that a carrier of a weight corresponding to the weight of the discharged carrier is replenished from the carrier container 11. As a typical example, one replenishment is carried out for 1 to 10 detections of the sensor 27. In this manner, the control unit replenishes the toner in accordance with the concentration of the toner detected by the toner concentration sensor, and also replenishes the carrier in accordance with the weight of the discharged developer material measured by the discharged developer material weighing part 20, whereby the developer material is refreshed little by little, thus preventing the developer material from being rapidly deteriorated. Accordingly, the control unit can make a constant amount of developer material of a constant toner concentration held in each of the first and second developer material supply path sections 5, 6. As a result, the developer material of the same quality can be supplied to the photoreceptor 1 for an extended period of time, and hence it is possible to carry out excellent image formation by means of the photoreceptor 1 for a long period of time. Thus, it will be appreciated that according to the present invention, it is possible to maintain the total amount of developer material in the development tank substantially at a constant level without using a complicated discharged amount detecting sensor, a complicated sensor for sensing the total amount of developer material, and the like.

This image forming apparatus can perform excellent image formation for a long period of time, and at the same time, the amount of discharged developer material collected in the discharged developer material receiving part 30 becomes large because the control unit can easily calculate the amount of discharged carrier based on the number of measurements N detected by the sensor 27. As a result, it is possible to easily detect when it comes to time that the discharged developer material receiving part 30 filled with the discharged developer material should be replaced with an empty one. Preferably, when it is detected that the time of replacement has come, an indication to that effect is made at a display device attached, or a warning sound is generated, so as to inform the operator of such a fact while continuing the formation of images. After that, however, it is also preferable to stop the image formation at appropriate timing. When the discharged developer material receiving part 30 has been replaced, the control unit resets the number of measurements N detected by the sensor 27, and repeats similar control operations as before. In this regard, let us consider the case where when a discharged developer material receiving part 30 is removed and replaced with another one, it may not be replaced with an empty discharged developer material receiving part 30. In this case, it may be constructed such that the inside of the discharged developer material receiving part 30 freshly installed can be seen through by means of an optical sensor or the like, and that only when the inside of the part 30 could be seen through by the optical sensor, it is detected that replacement with an empty discharged developer material receiving part 30 was effected.

A lock mechanism (not shown), which is to be used such as when a main electric power supply to the pocket 25 is turned off, is arranged in the discharged developer material weighing part 20. For instance, such a lock mechanism can be achieved by a simple arrangement comprising a solenoid, a plunger and a return spring. When the main power supply is turned on, the solenoid draws in the plunger thereby to make the pocket 25 rotatable. On the other hand, when the main power supply is turned off, the plunger is caused to project from the solenoid under the action of the return spring, whereby the pocket 25 is locked against rotation. Also, it is needless to say that the weight member 23 may instead be locked as another measure. If such a lock mechanism is not provided, when the image forming apparatus equipped with the developing apparatus is greatly inclined for its movement for instance, a large amount of developer material will flow out from the developer material discharge port 14 into the discharged developer material measurement and collection part 16. The outflow of the developer material is a defect of the overflow method. However, with the provision of this lock mechanism, the amount of outflow of the developer material is, at the maximum, equal to the volume of one pocket 25, and there may be the case that the outflowed developer material is returned when the inclination is reversed. Consequently, useless consumption of the developer material is maintained at an extremely small amount. It is needless to say that any well-known structure for preventing rotation of the pocket during the main electric power supply is turned off can be employed optionally as the lock mechanism besides the above-mentioned ones.

Here, it is to be noted that the first developer material supply path section 5 of the above-mentioned image forming apparatus is formed in such a manner that a portion of the bottom thereof facing the developer material discharge port 14 and the opening 18 becomes gradually shallow toward the direction of transportation of the developer material. In addition, in this portion, the outside diameter of the first developer material supply device 3 is formed to gradually decrease, too. It is also beneficial to apply such a structure to the second developer material supply path section 6. That is, the portion of the bottom surface of the second developer material supply path section 6 facing the opening 17 is formed to become gradually shallow toward the transportation direction DL of the developer material, and the outside diameter of the second developer material supply device 4 gradually decreases toward the same direction, too. As a result, the developer material can be caused to smoothly flow from the second developer material supply path section 6 into the first developer material supply path section 5 without staying at the corners of the terminal end of the second developer material supply path section 6. Moreover, the above-mentioned developing apparatus can be applied to monochrome printers employing a two-component trickle development method, full-color four-row tandem printers, color printers, color copying machines, etc. Here, note that an example of separately supplying a toner and a carrier has been described, but in cases where a developer material with a toner of a high concentration admixed therein is replenished, similar results will be obtained if control is performed such that a constant amount of carrier is held in the development tank.

The image forming apparatus of the present invention is constructed as explained above. Thus, a discharged developer material weighing mechanism receives a developer material discharged from a developer material discharge port, and each time the accumulated weight of the discharged developer material thus received reaches a prescribed weight, the received discharged developer material is discharged into a discharged developer material receiving part. A sensor detects this discharge, and a control unit counts this detection. The control unit can calculate an amount of carrier decreased from this count. As a result, the control unit drives a replenishment device to replenish the carrier and refresh the developer material little by little. On the other hand, the consumption of the toner is detected by a toner concentration sensor, and the control unit replenishes the toner from the replenishment device. The mixing ratio by weight of the toner and the carrier, which together constitute the developer material, and the amount of developer material held in a developer material supply path is kept constant under such a control operation of the control unit. Accordingly, the formation of excellent images can be carried out without deteriorating the developer material for an extended period of time. In addition, the discharged developer material weighing mechanism can be achieved by mechanical parts of simple structure, and is also easy to handle. Furthermore, according to the present invention, the developer material supply path is constituted by a first and a second developer material supply path section arranged in parallel with each other, and hence it is reduced in its size. A first auger and a second auger are arranged in the first and second developer material supply path sections, respectively. The bottoms of the first and second developer material supply path sections in their transportation terminating ends are made gradually shallow toward the direction of transportation. With this arrangement, it is possible to prevent the developer material from staying in the transportation terminating ends.

What is claimed is:

1. An image forming apparatus equipped with a developing apparatus in which a toner and a carrier constituting a developer material are replenished from a replenishment device to a developer material supply path and an excess part of the amount of developer material to be held in the developer material supply path is discharged from a developer material discharge port as a discharged developer material and received in a discharged developer material receiving part, characterized in that said developing apparatus, for the purpose of replenishing the carrier, comprises:

a discharged developer material weighing mechanism which receives the discharged developer material discharged from the developer material discharge port, and discharges the discharged developer material thus received into the discharged developer material receiving part each time the accumulated weight of the received discharged developer material reaches a prescribed weight;

a sensor which detects that the discharged developer material weighing mechanism has discharged the discharged developer material into the discharged developer material receiving part; and a control unit which calculates an amount of discharge carrier corresponding to the detection of the sensor, and replenishes the carrier corresponding to the amount of discharged carrier thus calculated from the replenishment device into the developer material supply path.

2. The image forming apparatus according to claim 1, wherein said discharged developer material weighing mechanism comprises: a rotation arm which is able to perform a seesaw movement about a rotation shaft within a prescribed angle range; a weight member which is mounted on one end of the rotation shaft; and a pocket which is mounted on the other end of the rotation arm and has a container shape for receiving the discharged developer material discharged from the developer material discharge port, said pocket being operable to rotate the rotation arm against the weight of the weight member and at the same time to discharge the discharged developer material received up to that time into the discharged developer material receiving part when the weight of the received discharged developer material exceeds a threshold, said pocket together with the rotation arm being returned to its original position under the action of the weight member after the discharge.

3. The image forming apparatus according to claim 2, wherein said discharged developer material weighing mechanism includes a lock mechanism which acts to lock the rotation arm against rotation thereof when a main electric power supply is turned off, and release the locking of the rotation arm when the main electric power supply is turned on.

4. The image forming apparatus according to claim 2, wherein said weight member is constructed such that a distance thereof from the rotation shaft is adjustable.

5. The image forming apparatus according to claim 2, wherein said control unit calculates the accumulated amount of developer material discharged into the discharged developer material receiving part based on the number of detections of the sensor, and when a prescribed amount of accumulation is reached, said control unit displays an indication of that effect at a display device, or generates a warning sound.

6. The image forming apparatus according to claim 1, wherein said control unit calculates the accumulated amount of developer material discharged into the discharged developer material receiving part based on the number of detections of the sensor, and when a prescribed amount of accumulation is reached, said control unit displays an indication of that effect at a display device, or generates a warning sound.

7. The image forming apparatus according to claim 1, wherein said developer material supply path comprises: a first developer material supply path section disposed adjacent to a developing roller for mixing and transporting the developer material along the developing roller; and a second developer material supply path disposed on the opposite side of the developing roller along the first developer material supply path section; wherein said developer material supply path is constructed such that the developer material is fed from a transportation terminating end of the second developer material supply path section at a transportation starting end of the first developer material supply path section, and the developer material is fed from a transportation terminating end of the first developer material supply path section to a transportation starting end of the second developer material supply path section at the transportation terminating end of the first developer material supply path section, and at the same time, a part of the developer material is discharged from the developer material discharge port as a discharged developer material, and a bottom of the first developer material supply path section at the transportation terminating end thereof becomes gradually shallow toward a direction of transportation.

8. The image forming apparatus according to claim 7, wherein a bottom of the second developer material supply path section is constructed such that it becomes gradually shallow toward the direction of transportation at the transportation terminating end of the second developer material supply path section, too, as at the transportation terminating end of the first developer material supply path section.

9. The image forming apparatus according to claim 7, wherein the image forming apparatus is constructed such that a first auger and a second auger both extending in the direction of transportation of the developer material are disposed in the first and second developer material supply path sections, respectively, and that the outer diameter of the first auger at the transportation terminating end of the first developer material supply path section decreases toward the direction of transportation so as to correspond to the bottom of the first developer material supply path section which becomes gradually shallow toward the direction of transportation.

10. The image forming apparatus according to claim 7, wherein the image forming apparatus is constructed such that a first auger and a second auger both extending in the direction of transportation of the developer material are disposed in the first and second developer material supply path sections, respectively, and that the outer diameters of the first and second augers at the transportation terminating ends of the first and second developer material supply path sections decrease toward the direction of transportation so as to correspond to the bottoms of the first and second developer material supply path sections which become gradually shallow toward the direction of transportation.

* * * * *